US006358662B1

(12) United States Patent
Dickerson et al.

(10) Patent No.: US 6,358,662 B1
(45) Date of Patent: Mar. 19, 2002

(54) RADIATION ONCOLOGY TREATMENT LOCALIZATION IMAGING FILM AND METHOD OF USE

(75) Inventors: Robert E. Dickerson, Hamlin; Eric L. Dillenbeck, Rochester, both of NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/731,272

(22) Filed: Dec. 6, 2000

(51) Int. Cl.[7] ..... G03C 1/035; G03C 1/09; G03C 1/46; G03C 5/17

(52) U.S. Cl. ..... 430/139; 430/502; 430/509; 430/428; 430/497; 430/966; 430/967

(58) Field of Search ..... 430/139, 502, 430/509, 966, 967, 997, 428

(56) References Cited

U.S. PATENT DOCUMENTS 5,871,892 A 2/1999 Dickerson et al. ..... 430/502
5,952,147 A 9/1999 Dickerson et al. ..... 430/502
6,042,986 A 3/2000 Dickerson et al. ..... 430/502

OTHER PUBLICATIONS

Co–pending US Application D–81631, *Radiation Oncology Treatment Portal Imaging Film And Method Of Use by Dickerson & Moore* filed on even date herewith, Dec. 6, 2000, Ser. No. 731272.

*Primary Examiner*—Richard L. Schilling
(74) *Attorney, Agent, or Firm*—J. Lanny Tucker

(57) ABSTRACT

Localization radiographic films containing rhodium-doped, cubic grain, high silver chloride emulsions can be used in radiographic imaging assemblies comprising intensifying screens for therapy imaging. The average silver halide grain size is from 0.20 to about 0.30 $\mu$m, and they comprise at least 80 mol % chloride based on total silver. These films provide colder image tones and reduced processing non-uniformities.

19 Claims, No Drawings

RADIATION ONCOLOGY TREATMENT LOCALIZATION IMAGING FILM AND METHOD OF USE

FIELD OF THE INVENTION

This invention is directed to radiography in which radiation is aimed at certain regions of a subject to provide therapy treatment. In particular, it is directed to a radiographic localization imaging film, to combinations of such films and intensifying screens, and to methods of use. This invention is useful in radiation therapy imaging.

BACKGROUND OF THE INVENTION

In conventional medical diagnostic imaging the object is to obtain an image of a patient's internal anatomy with as little X-radiation exposure as possible. The fastest imaging speeds are realized by mounting a dual-coated radiographic element between a pair of fluorescent intensifying screens for imagewise exposure. About 5% or less of the exposing X-radiation passing through the patient is adsorbed directly by the latent image forming silver halide emulsion layers within the dual-coated radiographic element. Most of the X-radiation that participates in image formation is absorbed by phosphor particles within the fluorescent screens. This stimulates light emission that is more readily absorbed by the silver halide emulsion layers of the radiographic element.

Examples of radiographic element constructions for medical diagnostic purposes are provided by U.S. Pat. No. 4,425,425 (Abbott et al) and U.S. Pat. No. 4,425,426 (Abbott et al), U.S. Pat. No. 4,414,310 (Dickerson), U.S. Pat. No. 4,803,150 (Kelly et al) and U.S. Pat. No. 4,900,652 (Kelly et al), U.S. Pat. No. 5,252,442 (Tsaur et al), and *Research Disclosure,* Vol. 184, August 1979, Item 18431.

Radiation oncology is a field of radiology relating to the treatment of cancers using high energy X-radiation. This treatment is also known as teletherapy, using powerful, high-energy X-radiation machines (often linear accelerators) to exposure the cancerous tissues (tumor). The goal of such treatment is to cure the patient by selectively killing the cancer while minimizing damage to surrounding healthy tissues.

Such treatment is commonly carried out using high energy X-radiation, 4 to 25 MVp. The X-radiation beams are very carefully mapped for intensity and energy. The patient is carefully imaged using a conventional diagnostic X-radiation unit, a CT scanner, and/or an MRI scanner to accurately locate the various tissues (healthy and cancerous) in the patient. With full knowledge of the treatment beam and the patient's anatomy, a dosimetrist determines where and for how long the treatment X-radiation will be directed, and predicts the radiation dose to the patient.

Usually, this causes some healthy tissues to be overexposed. To reduce this effect, the dosimetrist provides one or more custom-designed "blocks" or shields of lead around the patient's body to absorb X-radiation that would impact healthy tissues.

To determine and document that a treatment radiation beam is accurately aimed and is effectively killing the cancerous tissues, two types of imaging are carried out during the course of the treatment. "Portal radiography" is generally the term used to describe such imaging. The first type of imaging is known as "localization" imaging in which the portal radiographic film is briefly exposed to the X-radiation passing through the patient with the lead shields removed and then with the lead shields in place. Exposure without the lead shields provides a faint image of anatomical features that can be used as orientation references near the targeted feature while the exposure with the lead shields superimposes a second image of the port area. This process insures that the lead shields are in the correct location relative to the patient's healthy tissues. Both exposures are made using a fraction of the total treatment dose, usually 1 to 4 monitor units out of a total dose of 45–150 monitor units. Thus, the patient receives less than 20 RAD's of radiation.

If the patient and lead shields are accurately positioned relative to each other, the therapy treatment is carried out using a killing dose of X-radiation administered through the port. The patient typically receives from 50 to 300 RAD's during this treatment. Since any movement of the patient during exposure can reduce treatment effectiveness, it is important to minimize the time required to process the imaged films.

A second, less common form of portal radiography is known as "verification" imaging to verify the location of the cell-killing exposure. The purpose of this imaging is to record enough anatomical information to confirm that the cell-killing exposure was properly aligned with the targeted tissue. The imaging film/cassette assembly is kept in place behind the patient for the full duration of the treatment. Verification films have only a single field (the lead shields are in place) and are generally imaged at intervals during the treatment regime that may last for weeks. Thus, it is important to insure that proper targeted tissue and only that tissue is exposed to the high level radiation because the levels of radiation are borderline lethal.

Portal radiographic imaging film, assembly and methods are described, for example, in U.S. Pat. No. 5,871,892 (Dickerson et al) in which the same type of radiographic element can be used for both localization and portal imaging.

Portal imaging assemblies can be grouped into two categories. The first type of assemblies includes one or two metal plates and a radiographic silver halide film that is designed for direct exposure to X-radiation. Two such films that are commercially available are KODAK X-ray Therapy Localization (XTL) Film and KODAK X-ray Therapy Verification (XV) Film. Each of these films is generally used with a single copper or lead plate. They have the advantage of having low contrast so that a wide range of exposure conditions can be used to produce useful images. However, because high energy X-radiation is used to produce therapy portal images, the contrast of the imaged tissues (target tissues) is also very low. Coupled with the low contrast of the imaging system, the final image contrast is very low and difficult to read accurately.

The second type of portal imaging assemblies includes a fluorescent intensifying screen and a silver halide radiographic film. These assemblies include one or two metal plates, one or two fluorescent intensifying screens, and a fine grain emulsion film. Because a significant amount of the film's exposure comes from the light emitted by the fluorescent screen(s), it is possible to use films that provide high contrast images. Thus, these imaging assemblies typically provide images having contrast 3.5 times higher than those direct imaging assemblies noted above do. However, the photospeed obtained with both types of assemblies is about the same. Moreover, the images from this second type of assemblies have much higher "NEQ", show clearer structure definition and are easier to read.

Recent advances in therapy localization imaging have been provided by the commercially available KODAK ECL System. Better visualization of anatomical landmarks for proper placement of lead shields prior to radiation therapy thus provides more accurate treatment. The use of such a system has become widespread as a result of these benefits.

As this technology is used in more hospitals, a wider variety of processing chemistries and processors are also encountered. In some processing chemistries, the noted imaging system exhibits an unacceptably warm image tone. In addition, in low volume processors (for example, shallow tray processors), processing non-uniformities (known as "stretch marks" or an "hour-glass pattern") may occur. These defects are both distracting in the image and may interfere with important anatomical landmarks in the image. The present invention is directed at solving these problems.

SUMMARY OF THE INVENTION

The present invention provides a solution to the noted problems with a radiographic silver halide film comprising a support having first and second major surfaces and that is capable of transmitting X-radiation, the film having disposed on the first major support surface, one or more hydrophilic colloid layers including a silver halide emulsion layer, and on the second major support surface, one or more hydrophilic colloid layers including a silver halide emulsion layers, each of the silver halide emulsion layers comprising rhodium-doped silver halide cubic grains that (a) have the same or different composition in each silver halide emulsion layer, (b) have an average grain size of from 0.20 to about 0.30 $\mu$m, and (c) are composed of at least 80 mol % chloride, up to 20 mol % bromide and up to 2 mol % iodide, based on total silver, all hydrophilic layers of the film being fully forehardened and wet processing solution permeable for image formation within 45 seconds.

This invention also provides a radiographic imaging assembly comprising the radiographic film described above provided in combination with an intensifying screen on either side of the film.

Further, this invention provides a method of providing a black-and-white image comprising contacting the radiographic film described above, sequentially, with a black-and-white developing composition and a fixing composition, the method being carried out within 90 seconds, dry-to-dry.

The present invention provides a means for localization imaging with a radiation film that can be processed in a wide variety of processing chemistries and processing equipment. Yet, the images provided have the desired "cold" image tone, that is preferably a b* value (defined below) of less than −8. In addition, the undesirable non-uniformities that are seen in shallow tray processors are reduced. Thus, the present invention provides both improved image tone and processing uniformity.

DETAILED DESCRIPTION OF THE INVENTION

Definition of Terms

The term "contrast" as herein employed indicates the average contrast derived from a characteristic curve of a radiographic element using as a first reference point (1) a density ($D_1$) of 0.25 above minimum density and as a second reference point (2) a density ($D_2$) of 2.0 above minimum density, where contrast is $\Delta D$ (i.e. 1.75)÷$\Delta\log_{10}E$ ($\log_{10}E_2-\log_{10}E_1$), $E_1$ and $E_2$ being the exposure levels at the reference points (1) and (2).

"Gamma" is described as the instantaneous rate of change of a D logE sensitometric curve or the contrast at any logE value.

"Peak gamma" is the point of the sensitometric curve where the maximum gamma is achieved.

Photographic "speed" refers to the exposure necessary to obtain a density of at least 1.0 plus $D_{min}$.

"Dynamic range" refers to the range of exposures over which useful images can be obtained.

The term "fully forehardened" is employed to indicate the forehardening of hydrophilic colloid layers to a level that limits the weight gain of a radiographic film to less than 120% of its original (dry) weight in the course of wet processing. The weight gain is almost entirely attributable to the ingestion of water during such processing.

The term "rapid access processing" is employed to indicate dry-to-dry processing of a radiographic film in 45 seconds or less. That is, 45 seconds or less elapse from the time a dry imagewise exposed radiographic film enters a wet processor until it emerges as a dry fully processed film.

In referring to grains and silver halide emulsions containing two or more halides, the halides are named in order of ascending concentrations.

The term "equivalent circular diameter" (ECD) is used to define the diameter of a circle having the same projected area as a silver halide grain.

The term "aspect ratio" is used to define the ratio of grain ECD to grain thickness.

The term "coefficient of variation" (COV) is defined as 100 times the standard deviation (a) of grain ECD divided by the mean grain ECD.

The term "covering power" is used to indicate 100 times the ratio of maximum density to developed silver measured in mg/dm$^2$.

The term "front" and "back" refer to locations nearer to and further from, respectively, the source of X-radiation than the support of the film.

The term "dual-coated" is used to define a radiographic film having silver halide emulsion layers disposed on both the front- and backsides of the support.

The term "RAD" is used to indicate a unit dose of absorbed radiation, that is energy absorption of 100 ergs per gram of tissue.

The term "portal" is used to indicate radiographic imaging, films and intensifying screens applied to megavoltage radiotherapy conducted through an opening or port in a radiation shield.

The term "localization" refers to portal imaging that is used to locate the port in relation to the surrounding anatomy of the irradiated subject. Typically exposure times range from 1 to 10 seconds.

The term "verification" refers to portal imaging that is used to record patient exposure through the port during radiotherapy. Typically exposure times range from 30 to 300 seconds.

The terms "kVp" and "MVp" stand for peak voltage applied to an X-ray tube times $10^3$ and $10^6$, respectively.

The term "fluorescent intensifying screen" refers to a screen that absorbs X-radiation and emits light.

The term "metal intensifying screen" refers to a metal screen that absorbs MVp level X-radiation to release electrons and absorbs electrons that have been generated by X-radiation prior to reaching the screen.

"Image tone" is a measure of the color of the developed silver image as viewed by transmission. Color values are determined by conventional CIE (Commission Internationale de l'Eclairage) color scale standards for spectra recorded from 400 to 700 nm using D5500 as the standard source of illumination. Image tone is the b* value from the CIELAB measurements and reflects the yellow-blue color balance. The more negative the b* number, the bluer the developed silver image appears. "Warm" or more yellow images (more positive b* values) are generally considered undesirable by many radiologists. A difference of 0.7b* units is considered a just noticeable difference for a standard observer.

*Research Disclosure* is published by Kenneth Mason Publications, Ltd., Dudley House, 12 North St., Emsworth, Hampshire P010 7DQ England.

The radiographic films of this invention include a flexible support having disposed on both sides thereof: one or more silver halide emulsion layers and optionally one or more non-radiation sensitive hydrophilic layer(s). The silver halide emulsions in the various layers can be the same or different, and can comprise mixtures of various silver halide emulsions in one or more of the layers.

In preferred embodiments, the film has the same silver halide emulsions on both sides of the support. It is also preferred that the films have a protective overcoat (described below) over the silver halide emulsions on each side of the support.

The support can take the form of any conventional radiographic element support that is X-radiation and light transmissive. Useful supports for the films of this invention can be chosen from among those described in *Research Disclosure,* September 1996, Item 38957 XV. Supports and *Research Disclosure,* Vol. 184, August 1979, Item 18431, XII. Film Supports.

The support is a transparent film support. In its simplest possible form the transparent film support consists of a transparent film chosen to allow direct adhesion of the hydrophilic silver halide emulsion layers or other hydrophilic layers. More commonly, the transparent film is itself hydrophobic and subbing layers are coated on the film to facilitate adhesion of the hydrophilic silver halide emulsion layers. Typically the film support is either colorless or blue tinted (tinting dye being present in one or both of the support film and the subbing layers). Referring to *Research Disclosure,* Item 38957, Section XV Supports, cited above, attention is directed particularly to paragraph (2) that describes subbing layers, and paragraph (7) that describes preferred polyester film supports.

In the more preferred embodiments, at least one non-light sensitive hydrophilic layer is included with the one or more silver halide emulsion layers on each side of the film support. This layer may be called an interlayer or overcoat, or both.

The silver halide emulsion layers comprise one or more types of silver halide grains responsive to X-radiation. Silver halide grain compositions particularly contemplated include those having at least 80 mol % chloride (preferably at least 85 and more preferably at least 88 mol % chloride) based on total silver in a given emulsion layer. Such emulsions include silver halide grains composed of, for example, silver chloride, silver iodochloride, silver bromochloride, silver iodobromochloride, and silver bromooiodochloride. Iodide is generally limited to no more than 2 mol % (based on total silver in the emulsion layer) to facilitate more rapid processing. Preferably iodide is from about 0.5 to about 1.5 mol % (based on total silver in the emulsion layer) or eliminated entirely from the grains. The silver halide grains in each silver halide emulsion unit (or silver halide emulsion layers) can be the same or different, or mixtures of different types of grains.

The silver halide grains useful in this invention can have any desirable morphology including, but not limited to, cubic, octahedral, tetradecahedral, rounded, spherical or other non-tabular morphologies, or be comprised of a mixture of two or more of such morphologies. Preferably, the grains in each silver halide emulsion have cubic morphology.

The cubic silver halide grains generally have an average diameter of from 0.20 to about 0.30 (preferably from about 0.22 to about 0.28 $\mu$m). In defining grain size, the term "about" refers to a variation of ±0.005 $\mu$m.

It may also be desirable to employ silver halide grains that exhibit a coefficient of variation (COV) of grain ECD of less than 20% and, preferably, less than 10%. In some embodiments, it may be desirable to employ a grain population that is as highly monodisperse as can be conveniently realized.

A variety of silver halide dopants can be used, individually and in combination, to improve contrast as well as other common properties, such as speed and reciprocity characteristics. A summary of conventional dopants to improve speed, reciprocity and other imaging characteristics is provided by *Research Disclosure,* Item 38957, cited above, Section I. Emulsion grains and their preparation, sub-section D. Grain modifying conditions and adjustments, paragraphs (3), (4), and (5).

Preferably, each silver halide emulsion layer contains one or more rhodium dopants for the silver halide grains. These dopants are generally present in an amount of from about $1\times10^{-5}$ to about $5\times10^{-5}$ mole per mole of silver in each emulsion layer, and preferably at from about $2\times10^{-5}$ to about $4\times10^{-5}$ mol/mol Ag in each emulsion layer. The amount of rhodium dopant can be the same or different in these layers. Preferably, the amount of rhodium dopant is the same in each emulsion layer.

Useful rhodium dopants are well known in the art and are described for example in U.S. Pat. No. 3,737,313 (Rosecrants et al), U.S. Pat. No. 4,681,836 (Inoue et al) and U.S. Pat. No. 2,448,060 (Smith et al). Representative rhodium dopants include, but are not limited to, rhodium halides (such as rhodium monochloride, rhodium trichloride, diammonium aquapentachlororhodate, and rhodium ammonium chloride), rhodium cyanates {such as salts of $[Rh(CN)_6]^{-3}$, $[RhF(CN)_5]^{-3}$, $[RhI_2(CN)_4]^{-3}$ and $[Rh(CN)_5(SeCN)]^{-3}$}, rhodium thiocyanates, rhodium selenocyanates, rhodium tellurocyanates, rhodium azides, and others known in the art, for example as described in *Research Disclosure,* Item 437013, page 1526, September 2000 and publications listed therein, all incorporated herein by reference. The preferred rhodium dopant is diammonium aquapentachlororhodate. Mixtures of dopants can be used also.

A general summary of silver halide emulsions and their preparation is provided by *Research Disclosure,* Item 38957, cited above, Section I. Emulsion grains and their preparation. After precipitation and before chemical sensitization the emulsions can be washed by any convenient conventional technique using techniques disclosed by *Research Disclosure,* Item 38957, cited above, Section III. Emulsion washing.

The emulsions can be chemically sensitized by any convenient conventional technique as illustrated by *Research Disclosure,* Item 38957, Section IV. Chemical Sensitization: Sulfur, selenium or gold sensitization (or any combination thereof) are specifically contemplated. Sulfur sensitization is preferred, and can be carried out using for example, thiosulfates, thiosulfonates, thiocyanates, isothiocyanates, thioethers, thioureas, cysteine or rhodanine. A combination of gold and sulfur sensitization is most preferred.

Instability that increases minimum density in negative-type emulsion coatings (that is fog) can be protected against by incorporation of stabilizers, antifoggants, antikinking agents, latent-image stabilizers and similar addenda in the emulsion and contiguous layers prior to coating. Such addenda are illustrated by *Research Disclosure,* Item 38957, Section VII. Antifoggants and stabilizers, and Item 18431, Section II: Emulsion Stabilizers, Antifoggants and Antikinking Agents.

It may also be desirable that one or more silver halide emulsion layers include one or more covering power enhancing compounds adsorbed to surfaces of the silver halide grains. A number of such materials are known in the art, but preferred covering power enhancing compounds contain at least one divalent sulfur atom that can take the form of a —S— or =S moiety. Such compounds include, but are not limited to, 5-mercapotetrazoles, dithioxotriazoles, mercapto-substituted tetraazaindenes, and others described in U.S. Pat. No. 5,800,976 (Dickerson et al) that is incorporated herein by reference for the teaching of the sulfur-containing covering power enhancing compounds. Such compounds are generally present at concentrations of at least 20 mg/silver mole, and preferably of at least 30 mg/silver mole. The concentration can generally be as much as 2000 mg/silver mole and preferably as much as 700 mg/silver mole.

It may again be desirable that one or more silver halide emulsion layers on each side of the film support include dextran or polyacrylamide as water-soluble polymers that can also enhance covering power. These polymers are generally present in an amount of at least 0.1:1 weight ratio to the gelatino-vehicle (described below), and preferably in an amount of from about 0.3:1 to about 0.5:1 weight ratio to the gelatino-vehicle.

The silver halide emulsion layers and other hydrophilic layers on both sides of the support of the radiographic film generally contain conventional polymer vehicles (peptizers and binders) that include both synthetically prepared and naturally occurring colloids or polymers. The most preferred polymer vehicles include gelatin or gelatin derivatives alone or in combination with other vehicles. Conventional gelatino-vehicles and related layer features are disclosed in *Research Disclosure,* Item 38957, Section II. Vehicles, vehicle extenders, vehicle-like addenda and vehicle related addenda. The emulsions themselves can contain peptizers of the type set out in Section II, paragraph A. Gelatin and hydrophilic colloid peptizers. The hydrophilic colloid peptizers are also useful as binders and hence are commonly present in much higher concentrations than required to perform the peptizing function alone. The preferred gelatin vehicles include alkali-treated gelatin, acid-treated gelatin or gelatin derivatives (such as acetylated gelatin, deionized gelatin, oxidized gelatin and phthalated gelatin). Cationic starch used as a peptizer for tabular grains is described in U.S. Pat. No. 5,620,840 (Maskasky) and U.S. Pat. No. 5,667,955 (Maskasky). Both hydrophobic and hydrophilic synthetic polymeric vehicles can be used also. Such materials include, but are not limited to, polyacrylates (including polymethacrylates), polystyrenes and polyacrylamides (including polymethacrylamides). Dextrans can also be used. Examples of such materials are described for example in U.S. Pat. No. 5,876,913 (Dickerson et al), incorporated herein by reference.

The silver halide emulsion layers (and other hydrophilic layers) in the radiographic films of this invention are generally fully hardened using one or more conventional hardeners. Thus, the amount of hardener in each silver halide emulsion and other hydrophilic layer is generally at least 2% and preferably at least 2.5%, based on the total dry weight of the polymer vehicle in each layer.

Conventional hardeners can be used for this purpose, including but not limited to formaldehyde and free dialdehydes such as succinaldehyde and glutaraldehyde, blocked dialdehydes, α-diketones, active esters, sulfonate esters, active halogen compounds, s-triazines and diazines, epoxides, aziridines, active olefins having two or more active bonds, blocked active olefins, carbodiimides, isoxazolium salts unsubstituted in the 3-position, esters of 2-alkoxy-N-carboxydi-hydroquinoline, N-carbamoyl pyridinium salts, carbamoyl oxypyridinium salts, bis(amidino) ether salts, particularly bis(amidino) ether salts, surface-applied carboxyl-activating hardeners in combination with complex-forming salts, carbamoylonium, carbamoyl pyridinium and carbamoyl oxypyridinium salts in combination with certain aldehyde scavengers, dication ethers, hydroxylamine esters of imidic acid salts and chloroformamidinium salts, hardeners of mixed function such as halogen-substituted aldehyde acids (e.g., mucochloric and mucobromic acids), onium-substituted acroleins, vinyl sulfones containing other hardening functional groups, polymeric hardeners such as dialdehyde starches, and copoly(acrolein-methacrylic acid).

In each silver halide emulsion layer in the radiographic film, the level of silver is generally at least 10 and no more than 13 mg/dm$^2$, and preferably at least 11 and no more than 12 mg/dm$^2$. In addition, the total coverage of polymer vehicle is generally at least 28 and no more than 36 mg/dm$^2$, and preferably at least 30 and no more than 34 mg/dm$^2$. The amounts of silver and polymer vehicle on the two sides of the support can be the same or different. These amounts refer to dry weights.

The radiographic films generally include a surface protective overcoat on each side of the support that is typically provided for physical protection of the emulsion layers. Each protective overcoat can be sub-divided into two or more individual layers. For example, protective overcoats can be sub-divided into surface overcoats and interlayers (between the overcoat and silver halide emulsion layers). In addition to vehicle features discussed above the protective overcoats can contain various addenda to modify the physical properties of the overcoats. Such addenda are illustrated by *Research Disclosure,* Item 38957, Section IX. Coating physical property modifying addenda, A. Coating aids, B. Plasticizers and lubricants, C. Antistats, and D. Matting agents. Interlayers that are typically thin hydrophilic colloid layers can be used to provide a separation between the emulsion layers and the surface overcoats. It is quite common to locate some emulsion compatible types of protective overcoat addenda, such as anti-matte particles, in the interlayers. The overcoat on at least one side of the support can also include a blue toning dye or a tetraazaindene (such as 4-hydroxy-6-methyl-1,3,3a,7-tetraazaindene) if desired.

The protective overcoat is generally comprised of a hydrophilic colloid vehicle, chosen from among the same types disclosed above in connection with the emulsion layers. In conventional radiographic films protective overcoats are provided to perform two basic functions. They provide a layer between the emulsion layers and the surface of the element for physical protection of the emulsion layer during handling and processing. Secondly, they provide a convenient location for the placement of addenda, particularly those that are intended to modify the physical properties of the radiographic film. The protective overcoats of the films of this invention can perform both these basic functions.

The various coated layers of radiographic films of this invention can also contain tinting dyes to modify the image tone to transmitted or reflected light. These dyes are not decolorized during processing and may be homogeneously or heterogeneously dispersed in the various layers. Preferably, such non-bleachable tinting dyes are in a silver halide emulsion layer.

An optional feature of the radiographic films of this invention is the presence of one or more microcrystalline particulate dyes in the silver halide emulsion layers (that is, the bottom emulsion layers). The presence of such dyes reduces crossover during film use in radiographic assemblies to less than 15%, preferably 10% or less and more preferably 5% or less. The amount in the film to achieve this result will vary on the particular dye(s) used, as well as other factors, but generally the amount of particulate dye is at least 0.5 $mg/dm^2$, and preferably at least 1 $mg/dm^2$, and up to and including 2 $mg/dm^2$.

The particulate dyes generally provide optical densities of at least 1.0, and preferably at least 1. Examples of useful particulate dyes and teaching of their synthesis are described in U.S. Pat. No. 5,021,327 (noted above, Cols. 11–50) and U.S. Pat. No. 5,576,156 (noted above, Cols. 6–7), both incorporated herein by reference for description of the dyes. Preferred particulate dyes are nonionic polymethine dyes that include the merocyanine, oxonol, hemioxonol, styryl and arylidene dyes. These dyes are nonionic in the pH range of coating, but ionic under the alkaline pH of wet processing. A particularly useful dye is 1-(4'-carboxyphenyl)-4-(4'-dimethylaminobenzylidene)-3-ethoxycarbonyl-2-pyrazolin-5-one (identified as Dye XOC-1 herein).

The dye can be added directly to the hydrophilic colloid as a particulate solid or it can be converted to a particulate solid after it has been added to the hydrophilic colloid, as described in U.S. Pat. No. 5,021,327 (Col. 49).

In addition to being present in particulate form and satisfying the optical density requirements described above, the dyes useful in the practice of this invention must be substantially decolorized during wet processing. The term "substantially decolorized" is used to mean that the density contributed to the image after processing is no more than 0.1, and preferably no more than 0.05, within the visible spectrum.

The radiographic imaging assemblies of the present invention are composed of a radiographic film as described herein and intensifying screens adjacent the front and back of the radiographic film. The screens are typically designed to absorb X-rays and to emit electromagnetic radiation having a wavelength greater than 300 nm. These screens can take any convenient form providing they meet all of the usual requirements for use in radiographic imaging. Examples of conventional, useful fluorescent intensifying screens are provided by *Research Disclosure,* Item 18431, cited above, Section IX. X-Ray Screens/Phosphors, and U.S. Pat. No. 5,021,327 (Bunch et al) and U.S. Pat. No. 4,994,355 (Dickerson et al), U.S. Pat. No. 4,997,750 (Dickerson et al), and U.S. Pat. No. 5,108,881 (Dickerson et al), the disclosures of which are here incorporated by reference. The fluorescent layer contains phosphor particles and a binder, optimally additionally containing a light scattering material, such as titania. Higher emission efficiencies are realized with phosphors such as calcium tungstate ($CaWO_4$) niobium and/or rare earth activated yttrium, lutetium or gadolinium tantalates, and rare earth activated rare earth oxychalcogenides and halides. When two fluorescent intensifying screens are employed, they can be independently selected, being the same or different in composition and emission efficiencies. A variety of such screens are commercially available from several sources including by not limited to, LANEX™, X-SIGHT™ and InSight™ Skeletal screens available from Eastman Kodak Company. The front and back screens can be appropriately chosen depending upon the type of emissions desired, the photicity desired, whether the films are symmetrical or asymmetrical, film emulsion speeds, and % crossover.

Exposure and processing of the radiographic films of this invention can be undertaken in any convenient conventional manner. The exposure and processing techniques of U.S. Pat. Nos. 5,021,327 and 5,576,156 (both noted above), are typical for processing radiographic films. Other processing compositions (both developing and fixing compositions) are described in U.S. Pat. No. 5,738,979 (Fitterman et al), U.S. Pat. No. 5,866,309 (Fitterman et al), U.S. Pat. No. 5,871,890 (Fitterman et al), U.S. Pat. No. 5,935,770 (Fitterman et al), U.S. Pat. No. 5,942,378 (Fitterman et al), all incorporated herein by reference. The processing compositions can be supplied as single- or multi-part formulations, and in concentrated form or as more diluted working strength solutions.

It is particularly desirable that the films of this invention be processed within 90 seconds ("dry-to-dry"), and preferably within 45 seconds and at least 20 seconds, including developing, fixing and any washing (or rinsing). Such processing can be carried out in any suitable processing equipment including but not limited to, a Kodak X-OMAT™ RA 480 processor that can utilize Kodak Rapid Access processing chemistry. Other "rapid access processors" are described for example in U.S. Pat. No. 3,545,971 (Barnes et al) and EP-A-0 248,390 (Akio et al). Preferably, the black-and-white developing compositions used during processing are free of any gelatin hardeners, such as glutaraldehyde.

Since rapid access processors employed in the industry vary in their specific processing cycles and selections of processing compositions, the preferred radiographic films satisfying the requirements of the present invention are specifically identified as those that are capable of dry-to-dye processing according to the following reference conditions:

| | |
|---|---|
| Development | 11.1 seconds at 35° C., |
| Fixing | 9.4 seconds at 35° C., |
| Washing | 7.6 seconds at 35° C., |
| Drying | 12.2 seconds at 55–65° C. |

Any additional time is taken up in transport between processing steps. Typical black-and-white developing and fixing compositions are described in the Example below.

Radiographic kits of the present invention can include one or more samples of radiographic film of this invention, one or more intensifying screens used in the radiographic imaging assemblies, and/or one or more suitable processing compositions (for example black-and-white developing and fixing compositions). Preferably, the kit includes all of these components. Alternatively, the radiographic kit can include a radiographic imaging assembly as described herein and one or more of the noted processing compositions.

In practicing the therapy imaging method of this invention, X-radiation, typically of from about 4 to about 25 MVp, is directed at a region of the subject (that is, patient) containing features to be identified by different levels of X-radiation absorption. This exposed region is generally somewhat larger than the radiotherapy target area for the purpose of obtaining a discernible image of anatomy reference features outside the targeted area. Thus, a first image is created in the radiographic film as the X-radiation penetrates the subject.

A shield containing a port is generally placed between the subject and the source of X-radiation, and X-radiation is again directed at the subject, this time through the portal, thereby creating a second image through the port that is superimposed on the first image in the radiographic film. The total exposure during these steps A and B for localization imaging is generally limited to 10 seconds or less.

The radiographic film and the various screens can be assembled and used in a cassette as is well known in the art.

The metal intensifying screens useful in the invention can also take any convenient conventional form. While the metal intensifying screens can be formed of many different types of materials, the use of metals is most common, since metals are most easily fabricated as thin foils, often mounted on radiation transparent backings to facilitate handling. Convenient metals for screen fabrication are in the atomic number range of from 22 (titanium) to 82 (lead). Metals such as copper, lead, tungsten, iron and tantalum have been most commonly used for screen fabrication with lead and copper in that order being the most commonly employed metals. Generally the higher the atomic number, the higher the density of the metal and the greater its ability to absorb MVp X-radiation.

Widely employed metal intensifying screen combinations include (a) front and back lead intensifying screens and (b) front copper and back lead intensifying screens.

EXAMPLE

Radiographic Film A (Control):

Radiographic Film A is a high contrast film that is often used for radiographic therapy imaging. It was a dual coated having the same silver halide emulsion on both sides of a blue-tinted 178 μm transparent poly(ethylene terephthalate) film support. The emulsions were chemically sensitized with sodium thiosulfate, potassium tetrachloroaurate, sodium thiocyanate and potassium selenocyanate, and spectrally sensitized with 234 mg/Ag mole of 5-chloro-2-(3-(1,3-dihydro-1-methyl-3-(3-sulfobutyl)-5-(trifluoromethyl)-2H-benzimidazol-2-ylidene)-1-propenyl)-3-ethyl-1-(2-hydroxyethyl)-6-(trifluoromethyl)-1H-benzimidazolium inner salt.

Radiographic Film A had the following layer arrangement on each side of the film support:

Overcoat

Interlayer

Emulsion Layer

The noted layers were prepared from the following formulations.

| | Coverage (mg/dm$^2$) |
|---|---|
| Overcoat Formulation | |
| Gelatin vehicle | 3.4 |
| Methyl methacrylate matte beads | 0.14 |
| Carboxymethyl casein | 0.57 |
| Colloidal silica (LUDOX AM) | 0.57 |
| Polyacrylamide | 0.57 |
| Chrome alum | 0.025 |
| Resorcinol | 0.058 |
| Whale oil lubricant | 0.15 |
| Interlayer Formulation | |
| Gelatin vehicle | 3.4 |
| Carboxymethyl casein | 0.57 |
| Colloidal silica (LUDOX AM) | 0.57 |

-continued

| | Coverage (mg/dm$^2$) |
|---|---|
| Polyacrylamide | 0.57 |
| Chrome alum | 0.025 |
| Resorcinol | 0.058 |
| Nitron | 0.044 |
| Emulsion Layer Formulation | |
| Cubic grain emulsion [AgClBr (70:30 halide ratio) 0.25 μm] | 11.5 |
| Gelatin vehicle | 26 |
| 2-Carboxy-4-hydroxy-6-methyl-1,3,3a,7-tetraazaindene | 2.1 g/Ag mole |
| 1-(3-acetamidophenyl)-5-mercaptotetrazole | 0.012 |
| Ethylenediaminetetraacetic acid, disodium salt | 0.22 |
| Bisvinylsulfonylmethylether | 2.4% based on total gelatin in all layers on that side |

Radiographic Film B (Invention):

Radiographic Film B is within the present invention and had the same layer arrangement and formulations as Film A except that silver iodobromochloride (1 iodide:9 bromide:90 chloride molar ratio) emulsions were used on both sides of the film support, and those emulsions were doped with diammonium aquapenta-chlororhodate.

The cassette used in this example was that commonly used in localization imaging. It consists of a 1 mm-copper front screen and two fluorescent gadolinium oxysulfite intensifying screens (KODAK LANEX Fast). One intensifying screen is in the back and the other is laminated to the copper screen in the front.

Samples of Radiographic Films A and B were exposed through a graduated density step tablet in a MacBeth sensitometer for 1/50th second to a 500 watt General Electric DMX projector lamp calibrated to 2650° K., filtered with a Corning C4010 filter to simulate a green-emitting X-ray screen exposure.

Processing of the exposed film samples for sensitometric evaluation was carried out using a processor commercially available under the trademark KODAK RP X-OMAT film Processor M6A-N, M6B, or M35A. Development was carried out using the following black-and-white developing composition:

| | |
|---|---|
| Hydroquinone | 30 g |
| Phenidone | 1.5 g |
| Potassium hydroxide | 21 g |
| $NaHCO_3$ | 7.5 g |
| $K_2SO_3$ | 44.2 g |
| $Na_2S_2O_5$ | 12.6 g |
| Sodium bromide | 35 g |
| 5-Methylbenzotriazole | 0.06 g |
| Glutaraldehyde | 4.9 g |
| Water to 1 liter, pH 10 | |

The film samples were in contact with the developer in each instance for less than 90 seconds. Fixing was carried out using KODAK RP X-OMAT LO Fixer and Replenisher fixing composition (Eastman Kodak Company).

Rapid processing has evolved over the last several years as a way to increase productivity in busy hospitals without compromising image quality or sensitometric response. Where 90-second processing times were once the standard, below 40-second processing is becoming the standard in medical radiography. One such example of a rapid processing system is the commercially available KODAK Rapid Access (RA) processing system that includes a line of X-ray sensitive films available as T-MAT-RA radiographic films that feature fully forehardened emulsions in order to maximize film diffusion rates and minimize film drying. Processing chemistry for this process is also available. As a result of the film being fully forehardened, glutaraldehyde (a common hardening agent) can be removed from the developer solution, resulting in ecological and safety advantages (see KODAK KWIK Developer below). The developer and fixer designed for this system are Kodak X-OMAT RA/30 chemicals. A commercially available processor that allows for the rapid access capability is the Kodak X-OMAT RA 480 processor. This processor is capable of running in 4 different processing cycles. "Extended" cycle is for 160 seconds, and is used for mammography where longer than normal processing results in higher speed and contrast. "Standard" cycle is 82 seconds, "rapid Cycle" is 55 seconds and "KWIK/RA" cycle is 40 seconds (see KODAK KWIK Developer below). The KWIK cycle uses the RA/30 chemistries while the longer time cycles use standard RP X-OMAT chemistry. The following Table I shows typical processing times (seconds) for these various processing cycles.

TABLE I

| Cycle | Extended | Standard | Rapid | KWIK |
|---|---|---|---|---|
| Developer | 44.9 | 27.6 | 15.1 | 11.1 |
| Fixer | 37.5 | 18.3 | 12.9 | 9.4 |
| Wash | 30.1 | 15.5 | 10.4 | 7.6 |
| Drying | 47.5 | 21.0 | 16.6 | 12.2 |
| Total | 160.0 | 82.4 | 55 | 40.3 |

The black-and-white developer useful for the KODAK KWIK cycle contained the following components:

| | |
|---|---|
| Hydroquinone | 32 g |
| 4-Hydroxymethyl-4-methyl-1-phenyl-3-pyrazolidone | 6 g |
| Potassium bromide | 2.25 g |
| Sodium sulfite | 160 g |
| Water to 1 liter, pH 10.35 | |

Optical densities are expressed below in terms of diffuse density as measured by a conventional X-rite Model 301TM densitometer that was calibrated to ANSI standard PH 2.19 and was traceable to a National Bureau of Standards calibration step tablet. The characteristic D vs. logE curve was plotted for each radiographic film that was imaged and processed. Speed was measured at a density of $1.0+D_{min}$.

The following TABLE II shows that image tone (b*) varies significantly depending in Film A upon the processing conditions. Although the image tone was "colder" with the standard KODAK RP X-OMAT processing chemistry ("RP") without "starter" chemistry added, introduction of twice as much "starter" chemistry resulted in a "warmer" image tone. "Starter" chemistry refers to a "starter" solution that "seasons" a fresh (newly mixed) solution with the proper amount of bromide ion such as would normally result when higher film volumes are processed in the processing equipment.

Film B (Invention) showed some image tone loss when processed using twice as much "starter" chemistry, but the original image tone was "colder" to begin with, the resulting image tone was just as desirable as that obtained in the "RP" chemistry without "starter" chemistry. In contrast the Control Film A, when processed in standard KODAK EX chemistry ("EX") showed only a slight decrease in image tone.

The following TABLE III shows the results from processing the two films to a uniform density of 1.2 in a conventional shallow-tray K90 processor. Film A provided an unacceptable level ("rating") of processing non-uniformities whereas Film B exhibited only a slight increase in processing non-uniformities.

TABLE II

| Film | b* Using "RP" Chemistry (no "starter") | b* Using "RP" Chemistry (2X "starter") | b* Using "EX" Chemistry |
|---|---|---|---|
| A | −9.5 | −4.3 | −1.9 |
| B | −13.3 | −9.3 | −9 |

TABLE III

| Film | Non-Uniformity Rating | Comments |
|---|---|---|
| A | 6 | Unacceptable |
| B | 1 | Acceptable |

The invention has been described in detail with particular reference to preferred embodiments thereof, but it will be understood that variations and modifications can be effected within the spirit and scope of the invention.

We claim:

1. A radiographic silver halide film comprising a support having first and second major surfaces and that is capable of transmitting X-radiation, said film having disposed on said first major support surface, one or more hydrophilic colloid layers including a silver halide emulsion layer, and on said second major support surface, one or more hydrophilic colloid layers including a silver halide emulsion layer, said silver halide emulsion layers independently comprising rhodium-doped silver halide cubic grains that (a) have the same or different composition in each silver halide emulsion layer, (b) have an average grain size of from 0.20 to about 0.30 $\mu$m, and (c) are composed of at least 85 mol % chloride, up to 20 mol % bromide, and up to 2 mol % iodide, based on total silver, and all hydrophilic layers of said film being fully forehardened and wet processing solution permeable for image formation within 45 seconds.

2. The film of claim 1 wherein said cubic silver halide grains of said silver halide emulsions are independently composed of at least 88 mol % chloride based on total silver in the emulsion.

3. The film of claim 1 wherein said cubic silver halide grains of said silver halide emulsions are independently composed of at least 88 mol % chloride, and from about 0.5 to about 1.5 mol % iodide, based on total silver in the emulsion.

4. The film of claim 1 wherein the cubic silver halide grains of each silver halide emulsion have the same composition.

5. The film of claim 1 wherein said cubic silver halide grains of said silver halide emulsions independently have an average grain size of from about 0.22 to about 0.28 $\mu$m.

6. The film of claim 1 further comprising an overcoat over said silver halide emulsion on each side of said film support.

7. The film of claim 6 further comprising an interlayer between each silver halide emulsion layer and said overcoat on each side.

8. The film of claim 1 comprising a polymer vehicle on each side of said support in a total amount of from about 28 to about 36 $mg/dm^2$ and a level of silver on each side of from about 10 to about 13 $mg/dm^2$.

9. The film of claim 1 wherein said rhodium dopant is present in each silver halide emulsion layers in an amount, independently, of from about $2\times10^{-5}$ to about $4\times10^{-5}$ mol/mol Ag in each of those emulsion layers.

10. The film of claim 8 wherein said rhodium dopant is present in the same amount in each silver halide emulsion layers.

11. The film of claim 1 wherein said rhodium dopant is a rhodium halide, rhodium cyanate, rhodium thiocyanate, rhodium selenocyanate, rhodium tellurocyanate, rhodium azide, or a mixture of any two or more of these.

12. The film of claim 1 wherein said rhodium dopant is diammonium aquapentachlororhodate.

13. A radiographic imaging assembly comprising the radiographic film of claim 1 provided in combination with an intensifying screen on either side of the film.

14. A method of providing a black-and-white image comprising contacting the radiographic film of claim 1, sequentially, with a black-and-white developing composition and a fixing composition, said method being carried out within 90 seconds to provide a black-and-white image.

15. The method of claim 13 wherein the resulting image has a b* rating of less than −8.

16. The method of claim 13 wherein said black-and-white developing composition is free of any photographic film hardeners.

17. The method of claim 13 being carried out for 60 seconds or less.

18. A radiographic kit comprising the radiographic film of claim 1 and one or more of the following:

a) an intensifying screen, b) a black-and-white developing composition, and c) a fixing composition.

19. A radiographic kit comprising the radiographic imaging assembly of claim 12 and one or more of the following:

a) a black-and-white developing composition, and b) a fixing composition.

* * * * *